US006109995A

United States Patent [19]

Altmann et al.

[11] Patent Number: 6,109,995

[45] Date of Patent: Aug. 29, 2000

[54] ELECTRODE FOR A HIGH-PRESSURE DISCHARGE LAMP, AND METHODS OF ITS MANUFACTURE

[75] Inventors: Bernhard Altmann, Langerringen; Rudolf Richter, Schwabmuenchen; Klaus Stedele, Kaufering, all of Germany

[73] Assignee: Patent-Treuhand-Gesellschaft F. Elektrische Gluehlampen mbH, Munich, Germany

[21] Appl. No.: 09/121,522

[22] Filed: Jul. 23, 1998

[30] Foreign Application Priority Data

Sep. 4, 1997 [DE] Germany ..... 197 38 574

[51] Int. Cl.[7] ..... H01J 9/14

[52] U.S. Cl. ..... 445/49; 313/631

[58] Field of Search ..... 445/49, 50; 313/631, 313/571

[56] References Cited

U.S. PATENT DOCUMENTS

| | | | |
|---|---|---|---|
| 3,678,575 | 7/1972 | Akeyama et al. | 445/49 |
| 4,117,367 | 9/1978 | De Bie et al. . | |
| 4,803,395 | 2/1989 | Matesco . | |
| 4,859,239 | 8/1989 | Passmore . | |
| 4,906,895 | 3/1990 | Pabst et al. . | |
| 5,179,313 | 1/1993 | Eves et al. . | |
| 5,422,539 | 6/1995 | Chodora . | |
| 5,774,780 | 6/1998 | Prause . | |

FOREIGN PATENT DOCUMENTS

| | | |
|---|---|---|
| 0 262 005 | 3/1988 | European Pat. Off. . |
| 0 299 230 | 1/1989 | European Pat. Off. . |
| 2 271 663 | 12/1975 | France . |
| 325464 | 9/1920 | Germany . |
| 37 01 212 | 10/1987 | Germany . |
| 42 29 317 A1 | 3/1994 | Germany . |
| 44 42 161 C1 | 3/1996 | Germany . |
| WO 91/02393 | 2/1991 | WIPO . |

OTHER PUBLICATIONS

"VDI Nachrichten" ("Bulletin of the Association of German Engineers") , No. 20, May 17, 1996, p. 11, entitled (translated) "Cross–rolling saves metal scrap".

Patent Abstracts of Japan; vol. 015, No. 250 (E–1082), Jun. 26, 1991 & JP 03 078929 A (Yokogawa Electric Corp), Apr. 4, 1991.

*Primary Examiner*—Kenneth J. Ramsey

*Attorney, Agent, or Firm*—Frishauf, Holtz, Goodman, Langer & Chick, P.C.

[57] ABSTRACT

The electrode of tungsten material has a cylindrical shaft and a conical tip, in which the conical tip is made essentially by radial deformation, such as hammering or cross-rolling, of the tip portion (9) of the electrode blank (5). This changes the grain structure to be converging. A flat top or plateau (10) can be ground at the very end of the tip.

20 Claims, 5 Drawing Sheets

ELECTRODE FOR A HIGH-PRESSURE DISCHARGE LAMP, AND METHODS OF ITS MANUFACTURE

Reference to related patents, the disclosures of which are hereby incorporated by reference:

U.S. Pat. No. 4,117,367, De Bie et al.

U.S. Pat. No. 4,859,239, Passmore

U.S. Pat. No. 5,422,539, Chodora, assigned to the assignee of the present application.

Reference to related technical literature: "VDI Nachrichten" ("Bulletin of the Association of German Engineers"), No. 20, May 17, 1996, page 11, entitled (translated) "Cross-rolling saves metal scrap".

FIELD OF THE INVENTION

The present invention relates to an electrode for discharge lamps, and more particularly to electrodes for high-pressure discharge lamps, as well as xenon and mercury arc lamps, and to a method of manufacturing such electrodes.

BACKGROUND

Electrodes of the type to which the present invention relates are typically made of tungsten which is powdered, pressed and then sintered. Usually, the so-manufactured blank is then subjected to deformation processes which also renders the material more dense, for example by hammering or rolling. The hammering is radially directed against a cylindrical blank. The referenced De Bie et al. U.S. Pat. No. 4,117,367, and U.S. Pat. No. 4,859,239, Passmore, describe such processes.

Radial hammering of a cylindrical blank deforms the material as it is passed through flat hammer jaws The object of this process is to obtain a uniform reduction of the diameter of the blank while, simultaneously, elongating the material. Rolling or drawing also decreases the diameter and increases the length. A typical reduction by hammering is about 20% of the original diameter for each process step.

Starting from a diameter of about 4 mm, it is possible to deform the material by a drawing process if a still smaller diameter is desired.

U.S. Pat. No. 5,422,539, Chodora, assigned to the assignee of the present application, describes an electrode for a high-pressure discharge lamp and a process of its manufacture, in which the tip of the electrode is, as is customary, shaped by a material removal manufacturing step, for example by turning or grinding. According to the Chodora disclosure, axial hammering, that is, in a compression direction, can give better results, since the tip is additionally rendered more dense.

In accordance with the state of the art, the stability of the grain structure could be influenced only when making the electrode blank. The grain limit boundary structures extend parallel to the axis of the wire or electrode blank, not only in the region of the shaft, but also in the region of the tip of the electrode. If the geometry of the tip of the electrode is generated by the known material removal process, such as turning, for example on a lathe, and/or grinding, then grain boundary structures terminate essentially uniformly distribute at the inclined surface of the tip and end thereat, as shown in FIG. 1.

It was not possible up to now to deflect the grain boundary structures, or direct, or center them towards the axis of the blank in the region of the tip, or in the region toward a flat tap or end surface at the electrode tip. The prior art processes resulted in a substantial quantity of scrap which had to be accepted in connection with material removal machining technology. The scrap resulted from the difference between the initial blank and the shape of the final electrode tip.

The technology of radial hammering or forging permitted manufacture of a tip only with very small conical angles, that is, under 10°, with ductile metals, such as iron, for example for sewing needles. Tungsten was considered as too brittle for use in this technology, and it was not considered possible to obtain cone angles over 10°.

THE INVENTION

It is an object to provide an electrode in which the manufacture results in a small amount of waste or scrap, and which, further, has improved behavior in operation, that is, when the lamp is burning.

Briefly, an essentially conical or frusto-conical tip of the electrode is made, essentially, by radial deformation of the shaft in the region of the tip and leading towards the tip.

In accordance with a feature of the invention, radial hammering or forging to generate a tip uses special types of hammer jaws. Rather than using flat jaws as is customary in the known cylindrical hammering of a sintered blank, suitably shaped hammering jaws are used, that is, shaped in accordance with the shape of the desired tip. The method step is used only after the sinter blank has been transformed to its final maximum diameter, and preferably after the individual electrode blanks were cut to length.

The material of the electrode in accordance with the present invention is a high temperature, high melting material, typically tungsten. Basically, for example, rhenium, osmium and tantalum or tantalum carbide or the like are also suitable. An activating or doping material such as thorium oxide ($ThO_2$) can be added. Frequently, doping materials such as oxides of aluminum, potassium or silicon, may also be used. Alloys, particularly alloys of tungsten, can be formed in accordance with the present invention.

In accordance with a feature of the present invention, the electrode is formed from a cylindrical base body, termed a shaft, and has a conically converging tip, in which the tip is essentially made by radial deformation.

The present invention has a number of advantages:

(a) It increases the stability of the grain structure in the tip region of the electrodes;

(b) the grain boundary structures are oriented at the tip towards the axis of the electrode and, especially, to a flat surface, or flat top, or plateau at the tip of the electrode;

(c) the electrode tip can be shaped strictly as desired;

(d) scrap of electrode material is substantially reduced;

(e) the grain structure in the region of the electrode tip can be controlled as desired;

(f) the wear and tear on the tools to shape the electrodes is substantially reduced; a decrease in the use of lathe and turning tools and cutters, grinding disks and the like is obtained.

Practicing the present invention has the specific advantage that the gentle radial deformation of the grain boundaries causes the grain boundaries to terminate practically entirely in the region close to the tip. These grain boundaries form ducts or channels for the doping material. Consequently, the burning behavior of the lamp is very quiet. The doping which contributes to good emission is preferentially diffused in the region of the grain boundaries.

Preferably, the tip of the electrode is formed as a truncated cone, that is, in frusto-conical shape, with a cone jacket and a flat end surface, or flat top, or plateau. The grain boundaries then primarily end in the region of this flat end surface. Doping substances are then primarily transported towards this flat surface region. Conversely, losses due to vaporization of doping substances from the jacket or circumference of the cone are minimized, which all has a positive effect with respect to the lifetime of the lamp.

Electrode tips with simple geometries can readily be made by radial deformation. This deformation can be done either by radial hammering or by cross-rolling. By deforming in this manner, the deforming parameters can be freely selected, for example temperature, cone angle, and degree of deformation. This permits an additional specifically targeted working process for the grain structure, which has positive effects with respect to the lifetime of the electrode as well as its burning characteristics.

The general principle of cross-rolling is known, and described for example in the referenced related technical literature "VDI Nachrichten" ("Bulletin of the Association of German Engineers"), No. 20, May 17, 1996, page 11, entitled (translated) "Cross-rolling saves metal scrap". This disclosure is directed to structural elements with large abrupt changes in diameter, for example forged workpieces made of titanium alloys. The cross roller is supplied with round jaws which are profiled in wedge shape. The profile is symmetrical. In contrast, for purposes of the present invention, round jaws are used with a non-symmetrical profile. The profile forms the tip of the electrode, without any abrupt changes or jumps in diameter.

Radial hammering, among others, results in a very fine grain structure with a marked decrease in grain size, independent of the diameter of the electrode and the deformation parameters. This fine structure is further strengthened by deformation, which results in a marked increase in hardness and, under some circumstances, also in increased density. The grain size and density at the tip can be changed typically by a factor of two or more, in comparison to the electrode shaft; sometimes factors of from 3 to 10 are also obtainable.

In accordance with a preferred feature of the invention, the electrode is doped, particularly with thorium oxide. It has been found that the added doping materials are also strongly comminuted by the radial deformation, which results in a finer and more homogeneous dispersion of the doping substances. The shape of the grain structures can be specifically influenced by deformation at the tip, so that the stability of the grain structure can be improved in the region of the thermally highly loaded tip of the electrode. Thus, with respect to the shaft, additional deformation of the desired grain structure can be specifically controlled.

In accordance with a feature of the invention, radially directed deformation forces are circumferentially applied against the tip portion of the electrode shaft, to change the tip portion of the shaft into a conical shape, while also changing the orientation of the grain structure within the tip portion to be essentially convergent.

Workpiece removal machining steps are avoided by shaping the end region of the shaft which will form the tip of the electrode. Possible final fine adjustments can be made by turning or grinding, that is, workpiece material removal. The use of materials for the electrodes is substantially reduced by 5% to 25%, since the scrap in the manufacture is effectively eliminated. The reduction in diameter in accordance with the invention, and the conical shape, which depends on the cone angle, are particularly economical when the workpiece has $ThO_2$ added. Scrap containing $ThO_2$, which must be treated as radioactive waste, is highly reduced.

The wear and tear on diamond grinding disks is reduced or practically eliminated. Such diamond grinding disks are very expensive, and not using them, or only to a very slight extent, is a substantial reduction in manufacturing costs.

The smaller the diameter of the electrode, the easier it is to carry out the radial deformation process. This is true particularly for hammering. In general principle, the method can be used also with still relatively large diameters up to about 50 mm. Particularly good results are obtained for cathodes intended for direct current operation. Cathodes and anodes for alternating current operation lamps also can be manufactured by the method.

Radial deformation, particularly hammering, always includes a tangential force component. Tips with an overall cone or opening angle $\alpha$ of maximally 90° can be manufactured. Preferably, however, the cone angle $\alpha$ is below 60°. As the forces cone angle increases, the deformation forces become active essentially only in the vicinity of the surface. The core region is not affected. This results in a sliding of the layers close to the surface on the core region than of those which are located further inwardly. Undesired hollow spaces or inclusions may then form.

Preferably, the tip is conical or frusto-conical. A frusto-conical shape, with a flat top or plateau, is particularly preferred since the grain boundaries, along which the doping material is transported, terminate in the plateau or surface facing the discharge.

Figure 2:
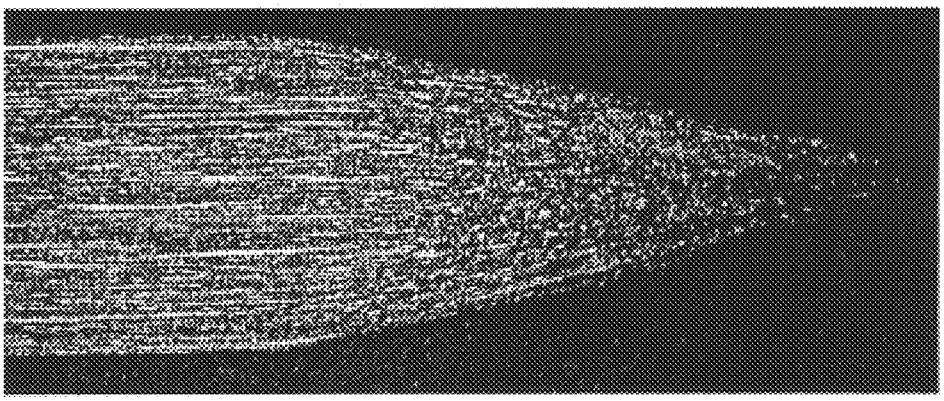
FIG. 2 is a cross section of a similar electrode of tungsten, the tip of which has been radially hammered, in accordance with a feature of the invention.
Figures 3A, 3B, 3C:
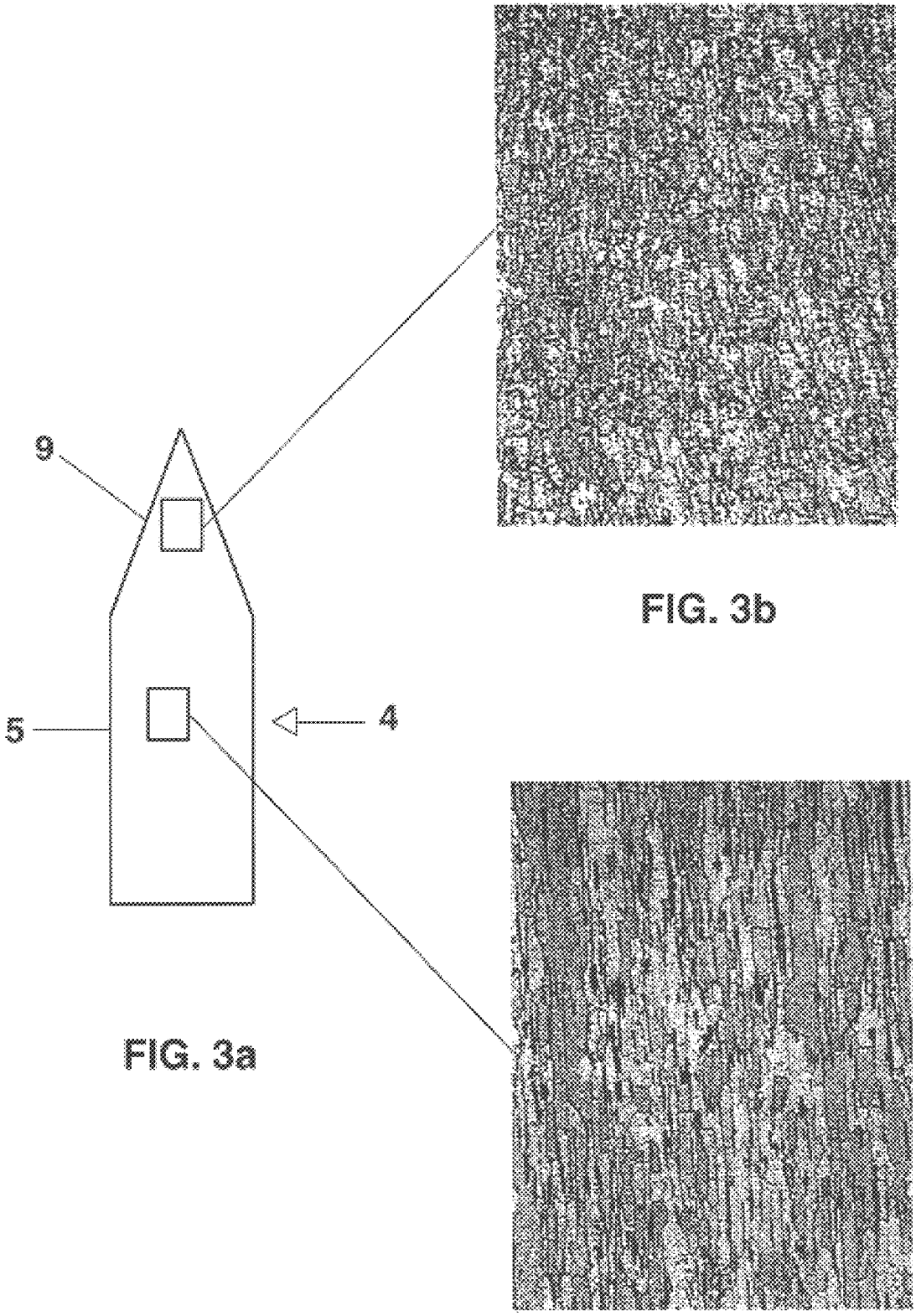

FIG. 3*a* is a highly schematic illustration of an electrode according to FIG. 2;

FIG. 3*b* is a highly enlarged view of a tip region of the electrode of FIG. 3*a;*

FIG. 3*c* is a highly enlarged view of the shaft region of the electrode of FIG. 3*a;*

Figure 4A:
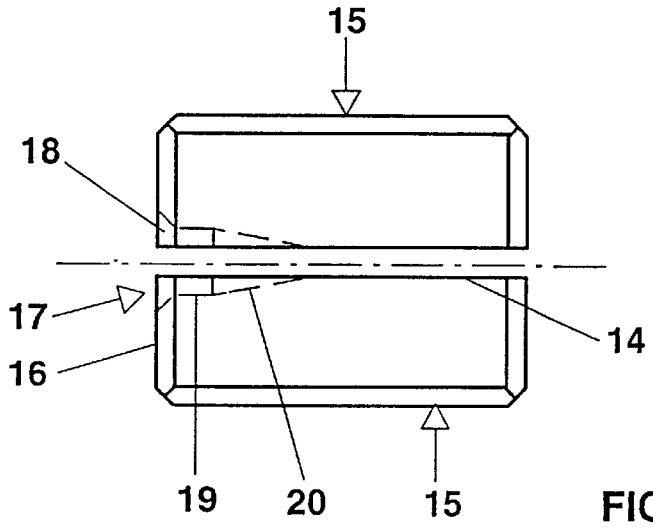
Figure 4B:
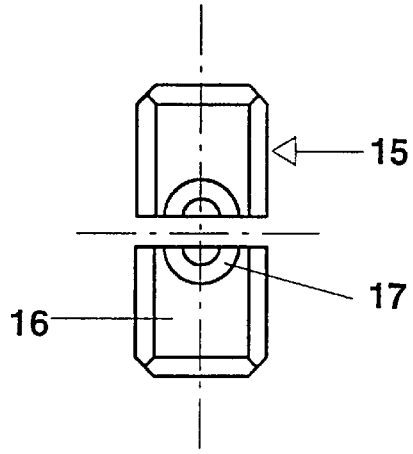

FIG. 4*a* is a schematic side view of a pair of hammering jaws for radial hammering;

FIG. 4*b* is a front view of the hammering jaws of FIG. 4*a;*

Figure 4C:
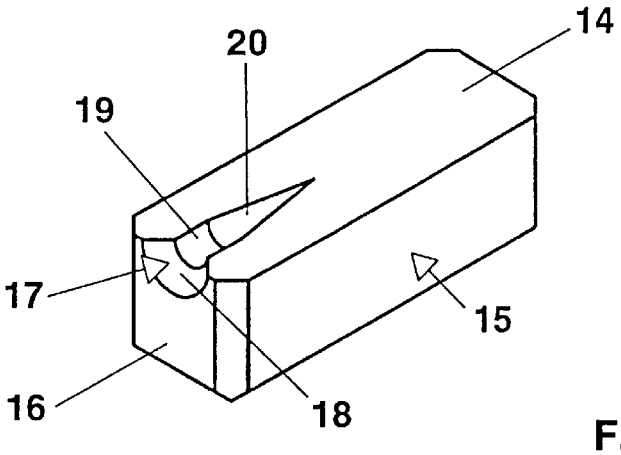
Figure 5:
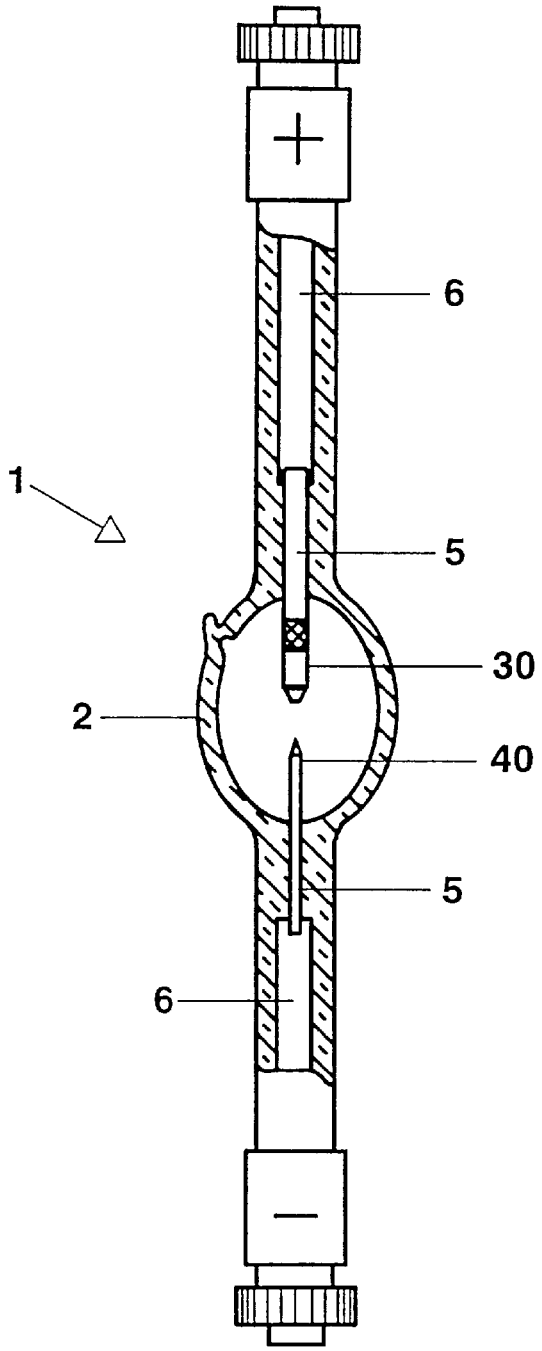
Figure 6:
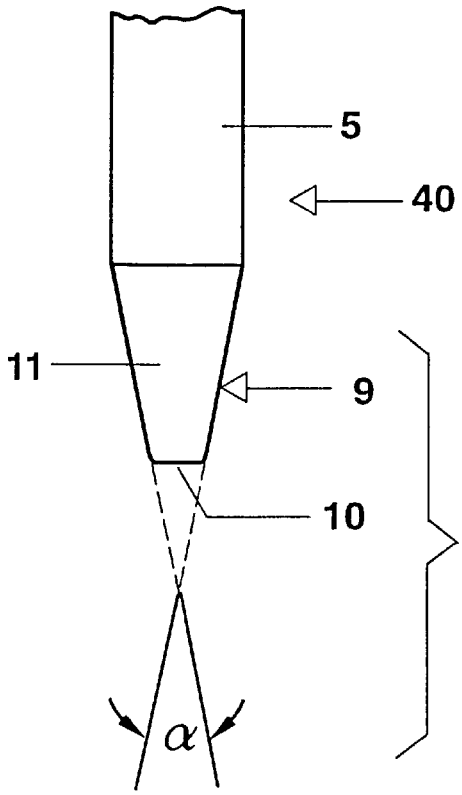

FIG. 4*c* is a perspective view of one hammering jaw;

FIG. 5 is a side view, partly in section, of a high-pressure discharge lamp having a radially deformed cathode in accordance with the present invention, and as illustrated in FIG. 2; and FIG. 6 is a side view of an end portion of the cathode in FIG. 5, to a highly enlarged scale, and also schematically illustrating the cone angle $\alpha$.

DETAILED DESCRIPTION.

Figure 1:
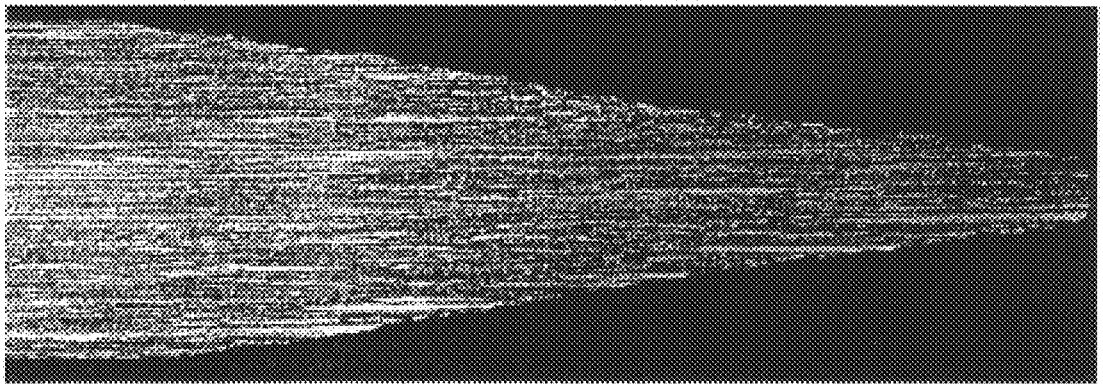
FIG. 1 is a cross-sectional view of/tungsten electrode, in accordance with the prior art, illustrating a tip portion which has been ground to shape.

Referring first to FIG. 1, which is a representation of an electrode of the prior art, made of tungsten material having additives of potassium, silicon and aluminum, to a greatly enlarged scale. The actual shaft diameter of the electrode is 1.5 mm. The tip of the electrode has been ground to conical shape. The grinding was done in conventional manner, with a diamond grinding disk.

FIG. 2 is a view similar to FIG. 1 of an electrode which has been deformed in accordance with the present invention by radial hammering, doped similarly to the FIG. 1 electrode, and also having a shaft diameter of 1.5 mm. The tip has been hammered to be round, that is, it has been deformed in accordance with the present invention by radial hammering.

FIGS. 3*a*, 3*b*, 3*c*, or FIG. 3 collectively, show one way of targeted influencing of the grain structure by radial hammering.

The electrode 4 has a diameter of 3 mm, and the cone angle at the tip is 40°. Two zones, 3*b* and 3*c*, are shown in FIG. 3*a*, and the respective zones are then illustrated in FIGS. 3*b*, 3*c*. The deformation zone 3*b*, in the region of the tip 9 of FIG. 3*a*, has been shaped by radial deformation, which in operation has been recrystallized. It is a circularly kneaded structure. This grain structure is substantially finer than the grain structure in the region 3*c* of the shaft 5, illustrated in FIG. 3*c*. The shaft 5 was made by the customary well-known drawing method. The foregoing is also valid for an annealing treatment for recrystallization.

Method of making the electrode:

Tungsten powder is first pressed, as is customary, and then sintered. The resulting sinter rod blank is rolled, hammered and, if necessary or desirable, drawn, until the desired final diameter is reached.

In accordance with the present invention, the tip of the electrode is then deformed by radial hammering of the tip region. The hammering is carried out with hammering jaws which have the desired geometry of the tip, worked into the hammering jaw profile or shape.

FIG. 4, collectively, shows a pair of hammering jaws in two views (FIGS. 4*a*, 4*b*) and one jaw in perspective view (FIG. 4*c*). The hammering jaws are block-shaped tool elements having a front side 16 facing the electrode shaft. The front side 16 is formed with a semicircular recess, cavity, or hollow space 17, which extends along one of the narrow sides 14 of the block. The hollow space or cavity 17 conically constricts inwardly. The cavity 17 is formed of three sections. It has an entrance opening 18 which is highly conical; a guide region 19 which is cylindrical, that is, of constant diameter, for the electrical shaft; and a tip-shaping portion 20 which conically converges with the desired opening angle of the tip of the electrode.

In operation, and to carry out the method, the cylindrical electrode blank extends, for treatment, between the two spaced jaws 15, see FIG. 4*a*. In advance of radial hammering, the electrode blank must be brought to a temperature suitable to permit treatment by deformation, as is customary. Then the tip region is hammered by means of the hammer jaws 15.

FIG. 5 is a highly schematic view of a xenon short-arc lamp 1, suitable for d-c operation, rated at 150 W, for photo-optical purposes. A discharge vessel 2 of quartz glass retains an anode 30 and a cathode 40. Each electrode 30 and 40 has the shaft 5, which is electrically and mechanically connected to a molybdenum foil 6, which is vacuum-tightly sealed in the ends of the discharge vessel 2.

The cathode 40 is shown to an enlarged scale in FIG. 6. It is made of tungsten, doped with 0.4% (by weight) of $ThO_2$. To ensure high stability of the arc, the base body forming the shaft 5 converges conically in form of a truncated cone to the tip 9. The surrounding surface 11 of the cathode terminates in a flat surface or plateau 10. The tip 9 is made by radial hammering and has the structure shown in FIG. 3 (collectively). The cone angle $\alpha$ is only 20°. The only workpiece removal step which is necessary is the shaping of the plane or flat top 10 by grinding.

A suitable heating temperature to which the electrode blank is heated before radial hammering is about 1300 to 1500° C.

Figure 7:
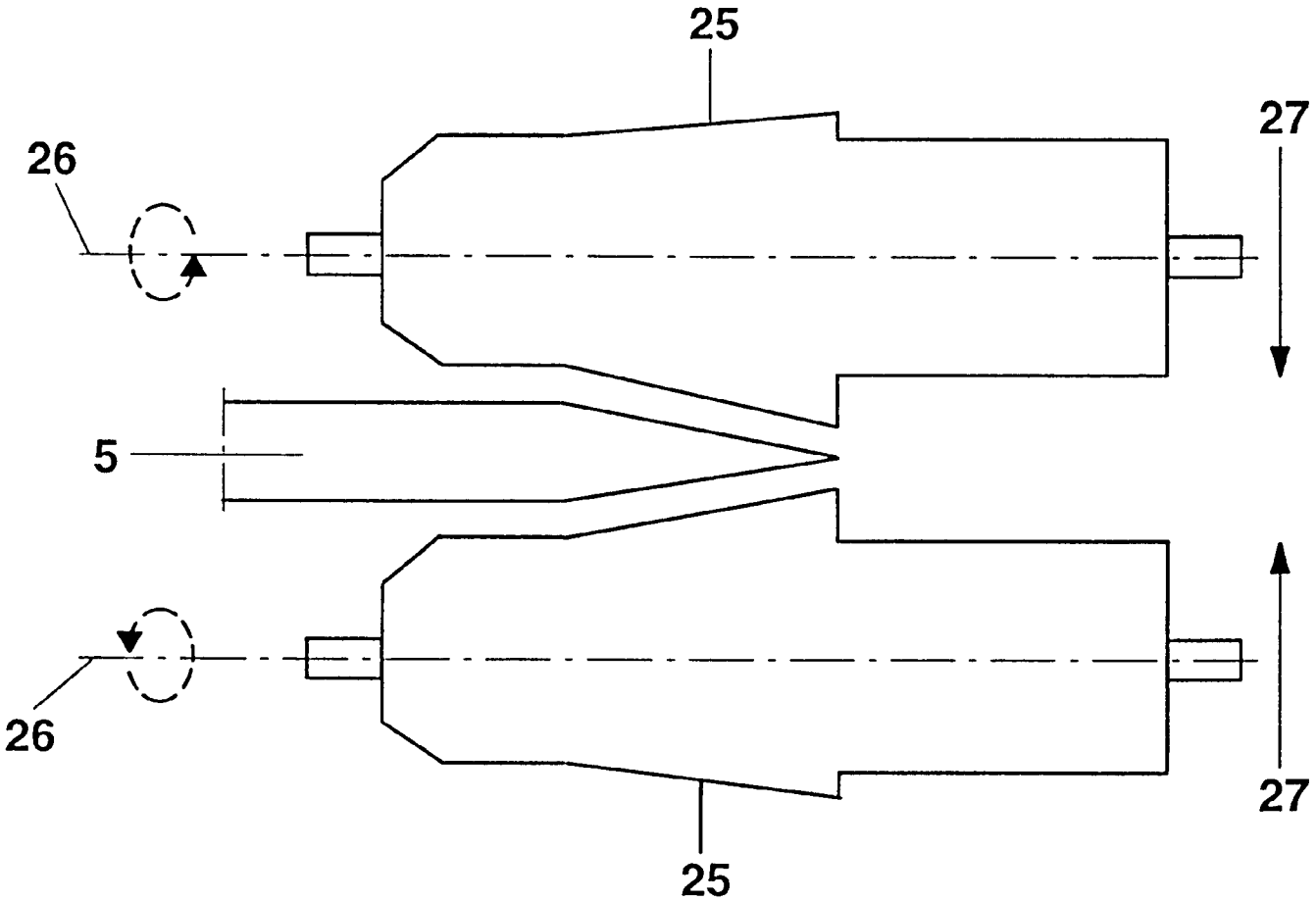

FIG. 7 illustrates a pair of deformation rollers to deform the tip region of an electrode blank, made as previously described in connection with FIG. 2. Rollers 25, which have a surface configuration roughly similar to the hammering jaws of FIG. 4*a* are rotatable about rotation axes 26. The rotation axes 26 are initially spaced from each other, similar to the gap of the narrower sides 14 of the hammering jaws, as shown in FIG. 4*a*. The rollers are then forcefully moved towards each other as schematically shown by arrows 27, thereby deforming the tip region of the electrode blank. For purposes of illustration, FIG. 7 illustrates the shaft 5, after the electrode tip has been rolled, with the rollers spread apart, for example for withdrawal of the electrode shaft.

We claim:

1. Electrode (4) for a high-pressure/discharge lamp of high melting point material, optionally tungsten, having a cylindrical shaft (5) terminating in a conical or frusto-conical tip (9), wherein, in accordance with the invention, said tip is made essentially by radial deformation of the material of the shaft in the region of, and leading towards, said tip (9).

2. The electrode of claim 1, wherein said material comprises doped tungsten.

3. The electrode of claim 1, wherein said radial deformation of the material comprises the step of radially hammering the material in the region of, and leading towards, said tip.

4. The electrode of claim 1, wherein said radial deformation of the material comprises the step of radially cross-rolling the material in the region of, and leading towards, said tip.

5. The electrode of claim 1, wherein said deformation step comprises increasing the hardness in the region of the tip (9) with respect to the hardness of the shaft.

6. The electrode of claim 1, wherein said deformation step comprises increasing the density of said material, upon carrying out said deformation step, in the region of said tip.

7. The electrode of claim 1, wherein the tip (9) terminates in a flat top or plateau (10).

8. The electrode of claim 1, wherein the average grain size in the region of the tip (9) is smaller than the grain size in the region of the shaft.

9. The electrode of claim 1, wherein the tip region of the electrode is essentially conical, and the cone angle is 90° or less.

10. The electrode of claim 1, wherein the tip region of the electrode is essentially conical, and the cone angle is 60° or less, optionally about 20°.

11. A discharge lamp, optionally a high-pressure discharge lamp, having a discharge vessel (2), and two electrodes (30, 40) sealed within the discharge vessel;

and wherein at least one of said electrodes comprises the electrode as claimed in claim 1.

12. A discharge lamp, optionally a high-pressure discharge lamp, having a discharge vessel (2), and two electrodes (30, 40) sealed within the discharge vessel;

and wherein at least one of said electrodes comprises the electrode as claimed in claim 3.

13. A discharge lamp, optionally a high-pressure discharge lamp, having a discharge vessel (2), and two electrodes (30, 40) sealed within the discharge vessel;

and wherein at least one of said electrodes comprises the electrode as claimed in claim 4.

14. A method to make an electrode for a high-pressure discharge lamp of high melting point material, optionally tungsten, having a cylindrical shaft (5) terminating in a conically shaped tip (9), as claimed in claim 1, comprising the steps of radially deforming the material of the tip portion of the shaft (5) of the electrode in the region of, and leading towards, the tip (9) of the electrode.

15. The method of claim 14, wherein the radial deformation step comprises radially hammering the tip portion of the electrode shaft.

16. The method of claim 14, wherein said deformation step comprises radially cross-rolling or cross-forging the tip portion of the electrode shaft.

17. A method to make an electrode for a high-pressure discharge lamp of high melting point material, optionally tungsten, having a cylindrical shaft (5) terminating in a conically shaped tip (9), as claimed in claim 1, comprising the steps of providing an essentially cylindrical electrode blank (5) defining a tip portion; and applying radially directed deformation forces circumferentially against the region of the tip portion of the blank of the shank to change the shape of the tip portion into conical shape, while changing the orientation of the grain structure of the tip portion to be essentially converging towards the tip of a theoretical cone.

18. Apparatus for radially hammering an electrode, as claimed in claim 1, comprising a pair of essentially block-shaped hammering jaws (15), said hammering jaws having a front side (16) and a narrow side (14) facing the electrode;

said hammering jaws being formed with a converging cavity (17) semicircularly extending, in conical manner, from the respective narrow side (14), to receive a portion of the electrode from the front side (16) and extending along the narrow side (14).

19. The apparatus of claim 18, wherein the cone angle of the conical cavity is less than 90°, optionally about 20°.

20. The apparatus of claim 18, wherein the cone angle of the conical cavity is between about 20° to 60°.

* * * * *